United States Patent [19]

O'Malley

[11] Patent Number: 4,626,839

[45] Date of Patent: Dec. 2, 1986

[54] PROGRAMMABLE VIDEO DISPLAY GENERATOR

[75] Inventor: Patrick J. O'Malley, Chandler, Ariz.

[73] Assignee: Motorola Inc., Schuamburg, Ill.

[21] Appl. No.: 551,812

[22] Filed: Nov. 15, 1983

[51] Int. Cl.[4] ..... G09G 1/14

[52] U.S. Cl. ..... 340/750; 340/723; 340/724; 340/732; 340/789

[58] Field of Search ..... 340/723, 724, 725, 729, 340/732, 744, 750, 789, 799; 358/148, 150, 151

[56] References Cited

U.S. PATENT DOCUMENTS

| | | | |
|---|---|---|---|
| 4,104,624 | 8/1978 | Hamada | 340/750 |
| 4,290,064 | 9/1981 | Traster | 340/723 |
| 4,462,028 | 7/1984 | Ryan et al. | 340/723 |
| 4,475,124 | 10/1984 | Ankeny et al. | 358/148 |
| 4,520,356 | 5/1985 | O'Keefe et al. | 340/723 |

*Primary Examiner*—Gerald L. Brigance
*Assistant Examiner*—Jeffery A. Brier
*Attorney, Agent, or Firm*—Dale E. Jepsen

[57] ABSTRACT

A video display system is provided having a programmable video display generator. The video display generator is divided into a control unit and an interface unit. The control unit has a dedicated display address generator which frees up the microprocessor used in the video display system. The system is capable of operation with several different microprocessors as well as with different types of random access memories. Circuitry within the interface unit advises the system of the type of microprocessor being used as well as the type of random access memory. The interface unit controls character generation as well as final attribute circuitry which gives the video display generator a high degree of capability while minimizing the amount of circuitry required.

6 Claims, 4 Drawing Figures

PROGRAMMABLE VIDEO DISPLAY GENERATOR

BACKGROUND OF THE INVENTION

This invention relates, in general, to raster scan video display systems, and more particularly, to a programmable video display generator for use in a video display system.

Video display systems are well known and have been widely used in recent years. Display systems are typically raster scan video display systems displaying images such as alphanumeric characters, fixed scenes, fixed objects and/or moveable objects. The greater number of modifications that can be made to the video presentation of images the more entertaining and more versatile is the video display system. One such system is disclosed in U.S. Pat. No. 4,290,064 which issued to Traster on Sept. 15, 1981. Yet a greater number of modifications to the images displayed, without greatly increasing the circuitry required, is desirable.

Accordingly, it is an object of the present invention to provide an improved programmable video display generator.

Another object of the present invention is to provide a video display generator which is useful in home computers as well as videotext displays and is compatible with all major world television standards with or without interlace.

A further object of the present invention is to provide a video display generator capable of supporting a large random access memory (RAM) and having a large number of available colors.

Another further object of the present invention is to provide a video display generator having game oriented attributes and smooth scrolling with the capability of operating with an 8-bit or a 16-bit microprocessor.

Yet another further object of the present invention is to provide a video display system having a virtual screen which is larger than the actual or displayed screen and having high vertical and horizontal resolution.

SUMMARY OF THE INVENTION

The above and other objects and advantages of the present invention are provided, in one form thereof, by using a programmable video display generator in a microprocessor control video display system. The video display generator is programmable and is divided into a control section and an interface section. The interface section is responsible for generating clock signals, microprocessor handshaking, and driving the random access memory address and control busses. The control section is responsible for generating the actual video output. The control section determines the addresses of the locations in RAM that must be accessed to create the video and processes the raw data received from RAM to create the video. The control section can process the video data into bit-plane picture elements (pixels) or the data can be routed to one of the control section's internal character generators. The control section has character generators which are available for either high quality alphanumerics or mosaic graphics. The control section has a display address generator which is essentially a dedicated MPU whose architecture and instructions have been optimized for display address generation calculations. Dedicated logic within the control section collects true object data during nonactive display time and then presents it at the correct pixel time. The control section also has a color mapping RAM (CMR) which allows the user to change colors quickly and easily.

The subject matter which is regarded as the present invention is set forth in the appended claims. The invention itself, however, together with further objects and advantages thereof, may be better understood by referring to the following detailed description taken in conjunction with the accompanying drawings.

DETAILED DESCRIPTION OF THE DRAWINGS

The present programmable video display generator is illustrated as being in two sections and has sophisticated video display capability which is usable with low cost microprocessor based systems. The video display generator is compatible with any current, or planned, member of the Motorola M68000 microprocessor family and with the Motorola M6809E mid-range microprocessor. The interconnection of the programmable video display generator will be illustrated connected in an 8-bit microprocessor, such as a Motorola M6809E microprocessor, and with a 16-bit microprocessor such as a Motorola M68000 microprocessor. An understanding of these two arrangements will permit those skilled in the art to use the present invention with yet other microprocessors.

Figure 1:
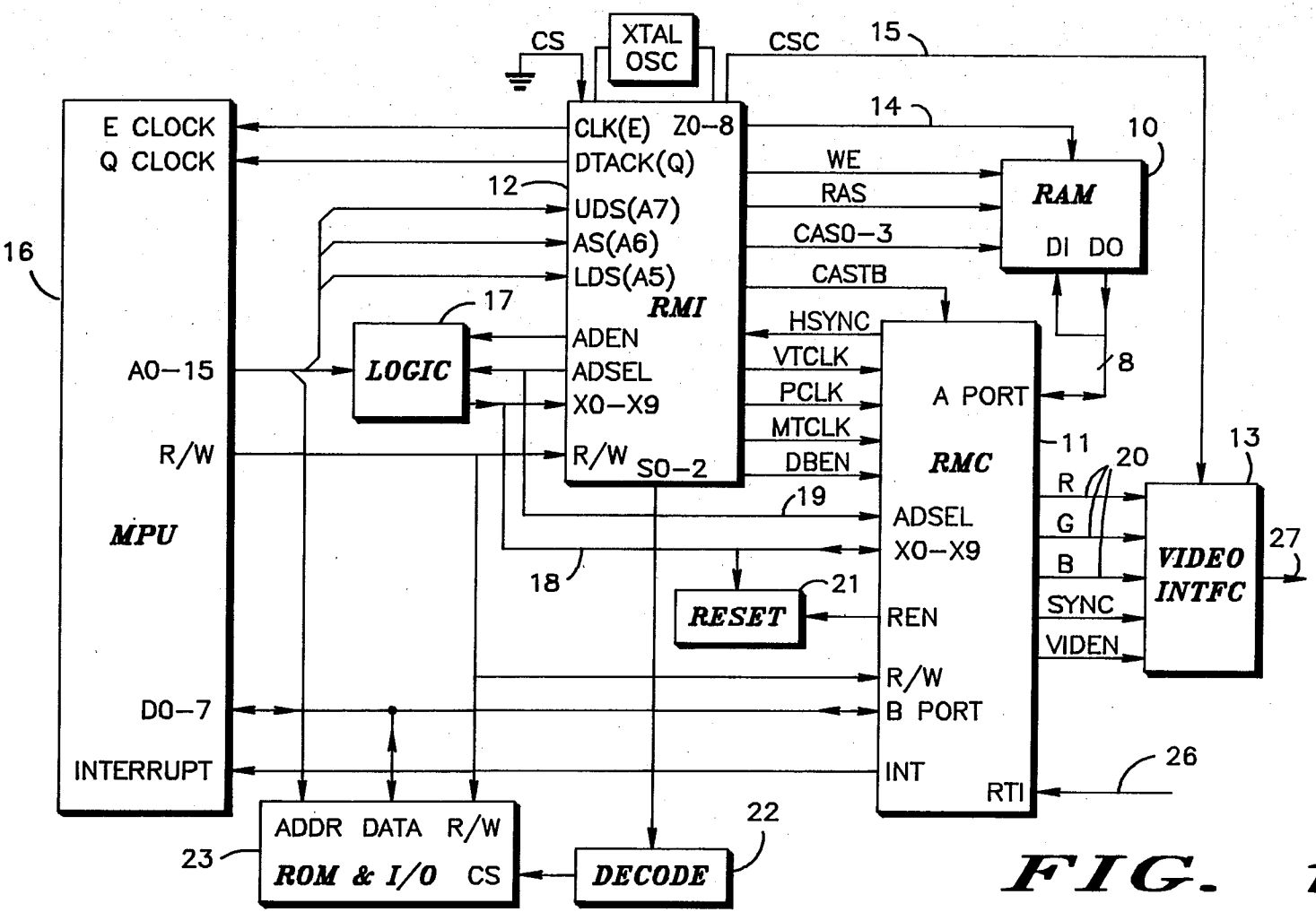
FIG. 1 illustrates, in block diagram form, a video display system using the present invention with an 8-bit microprocessor.

FIG. 1 illustrates in block diagram form a video display system having an 8-bit microprocessor 16. Random access memory (RAM) 10 represents a bank of from 1 to 4 banks of dynamic RAMs which are connected to an 8-bit data bus going to an A port of raster memory control (RMC) 11. RMC 11 represents the control section of the video display system. RAM 10 receives its addresses on Z bus 14 which is connected to raster memory interface (RMI) 12. RMI 12 represents the interface section of the video display system. Interface unit 12 also provides row address strobe (RAS) signal, write enable signal (WE), and column address strobe (CAS) signals to RAM 10. Only one write enable and one row address strobe line is provided but since RAM 10 represents a plurality of random access memories the number of column address strobe lines (CAS 0–3) required is equal to the number of banks of RAM. In the present illustration it is assumed that four banks (0–3) are being used. Interface unit 12 also provides a color subcarrier (CSC) signal on line 15 to video interface circuit 13. Video interface 13 also receives sync and video enable (VIDEN) signals along with R, G, and B signals from control unit 11. The R, G, and B color signals are normally interpreted as red, green and blue which are the primary colors from which all other colors can be generated. The R, G, and B color signals are coupled from control unit 11 to video interface circuit 13 on lines 20. Video interface circuit 13 provides a video output signal on line 27 which would typically be connected to a raster display (not shown). RMC 11 receives a real time interrupt (RTI) input signal on line 26 from an input such as a light pen. Microprocessor 16 is interconnected with interface unit 12, control unit 11 and logic circuitry 17, and a read only memory (ROM) 23. Although ROM and I/O 23 is illustrated as being a single block it will be understood that it could be several desired input/output (I/O) devices and/or memories. Logic circuitry 17 is also connected to a reset circuit 21 and to control unit 11 by X-bus 18, which in a preferred embodiment is a 10-bit bus. A chip select decode circuit 22 receives a signal on a 3-bit bus from interface unit 12 and provides a chip select output to ROM 23.

Microprocessor 16 receives the basic MPU clock signal, shown as CLK(E), from interface unit 12 and also receives Q clock signal from interface unit 12. MPU 16 also provides address signals on its outputs AO–15, which is a 16-bit bus, to logic circuit 17 and to ROM and I/O 23. Address bits 5, 6 and 7 (A5, A6, A7) are directly connected to interface unit 12. Logic circuit 17 receives an address enable (ADEN) and an address select (ADSEL) signal from RMI 12, and provides address signals to RMI 12 and to RMC 11 on bus 18. These address signals also go to reset circuit 21. Reset circuit 21 receives a reset enable (REN) signal from RMC 11. The address select signal provided by RMI 12 is also connected to RMC 11 by line 19. RMI 12 also provides a data bus enable (DBEN) signal along with several clock signals (VTCLK, PCLK, MTCLK) to RMC 11. RMC 11 provides a horizontal sync (HSYNC) signal to RMI 12 and receives a CASTB signal. The CASTB signal is a composite of the CAS signals and changes state with each change of state of the CAS signals during the display portion of the memory cycle and is used to strobe display data from RAM 10 into RMC 11. RMC 11 provides an interrupt signal to MPU 16 and receives a read/write (R/W) command signal from MPU 16. The R/W signal also goes to ROM and I/O 23 and to RMI 12. Data is transferred on B port bus between RMC 11, ROM and I/O 23 and MPU 16. RMI 12 has a chip select (CS) line which is connected to ground and also receives an input from a crystal oscillator which is used as the basic timing for the display system.

In a preferred embodiment, the system illustrated in FIG. 1 would use an M6809E microprocessor. Logic circuit 17 is, in a preferred embodiment, a 74ALS logic circuit which is also made and sold by Motorola, Inc. The MPU 16 address bus AO–15 must be multiplexed to enter RMI 12 and RMC 11, and logic unit 17 performs this function. Two or three 74ALS257s will be required depending upon the 8-bit MPU in use. Three packages of 74ALS257s will be required in the 16-bit data bus MPU system illustrated in FIG. 2.

Figure 2:
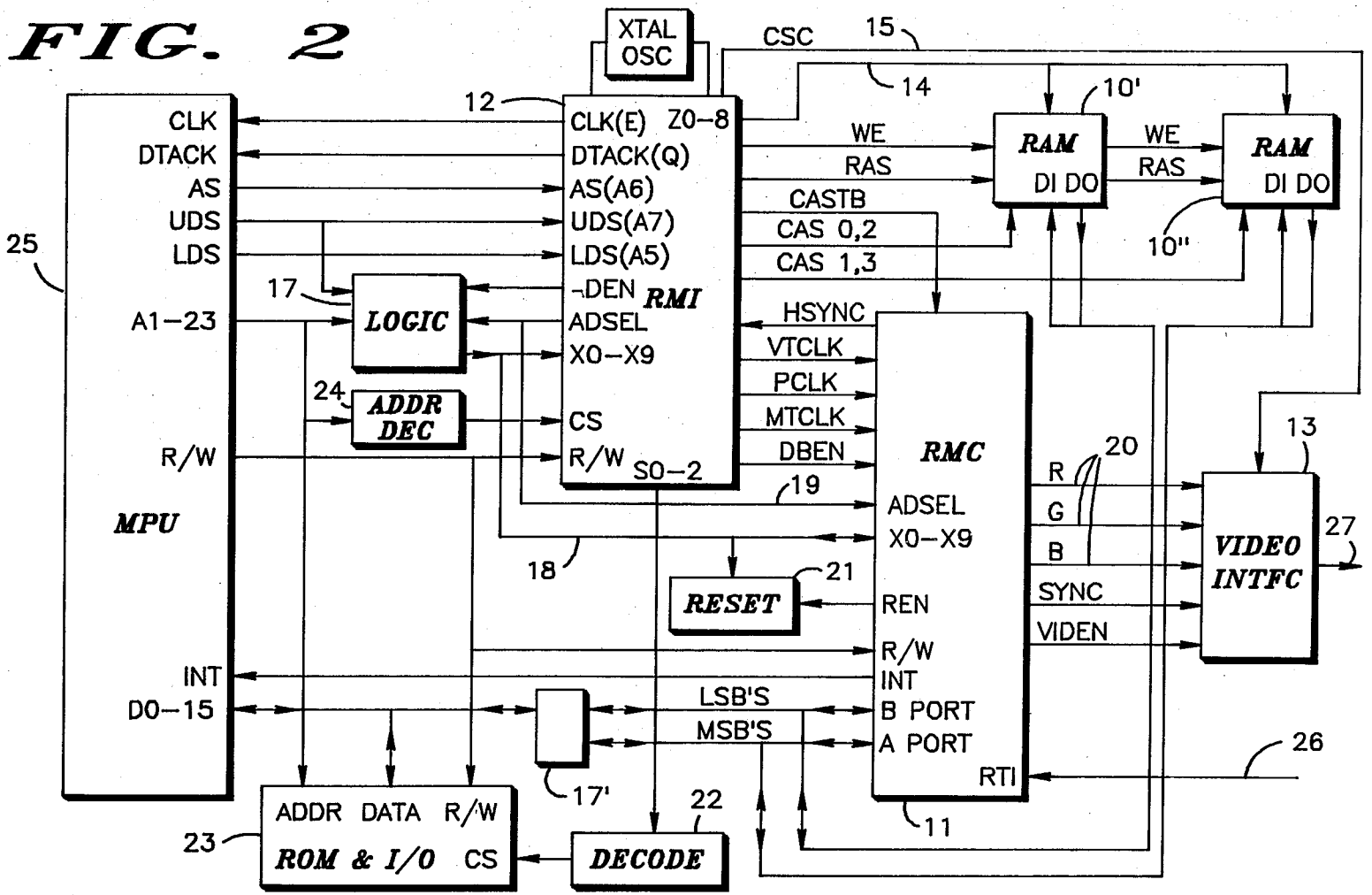
FIG. 2 illustrates, in block diagram form, a video display system using the present invention with a 16-bit microprocessor.

The block diagram illustrated in FIG. 2 shows a video display system having a 16-bit MPU 25. Many of the same circuits and interconnections illustrated in FIG. 1 are used and these will not be further explained. RAM 10 has been illustrated as RAM 10' and RAM 10'' to illustrate the 16-bit data handling capability. The data out of RAM 10' is shown going to B port of RMC 11 and the data from RAM 10'' is shown going to A port of RMC 11. Both of these ports are also connected to logic unit 17' which interconnects these two busses into the 16-bit data bus connected to DO–15 of MPU 25. The 16-bit data bus also goes to the data input/output of ROM and I/O 23. The CAS signal from RMI 12 is shown as CAS 0 and 2 going to RAM 10' and CAS 1 and 3 going to RAM 10''. Also address bus A1–23 from MPU 25 is shown as a 23-bit bus going to the address input of ROM and I/O 23 and being reduced to a 19-bit bus to enter logic unit 17 and as a 4-bit bus going to address decoder 24. Address decoder 24 provides an output to a chip select (CS) input of RMI 12. The operation of the systems of FIGS. 1 and 2 will be better understood by an explanation of RMI 12 and RMC 11 which will be given hereinafter.

The video display system requires either 1, 2, or 4 banks of dynamic RAM. Each bank is 8-bits wide. All of the banks must be of the same length. Commonly available lengths are 16K, 64K or 256K bytes. Therefore, the smallest amount of dynamic RAM the system can support is 16K bytes, and the largest is 1 megabyte. There are video performance advantages from having more than one bank of dynamic RAM. However, there is no difference in video performance between 2 and 4 bank systems. In a preferred embodiment of the present invention, industry standard 16K×1, 16K×4, 64K×1, and 256K×1 dynamic RAMs can be used.

During power up a reset is generated and the system is already at work to insure that the microprocessor powers up correctly. RMI 12 generates the appropriate clocks required by the microprocessor and RMC 11. Both RMI 12 and RMC 11 will configure themselves to properly interface to the type of MPU present in the system. The type of MPU in the system will signal to RMC 11 and RMI 12 by single transistor (reset circuit 21) connected to bus 18. The reset signal supplied by reset circuit 21 informs the system whether an 8-bit MPU or a 16-bit MPU is in use. It also determines whether the basic video timing of RMC 11 should conform to 525 or 625 line video standards. The system makes very few assumptions about system operation at power up. The microprocessor is expected to configure the system, via software, after power up and before any video displays can be generated. This configuration falls into two categories. The first category is system configuration, and the second category is video display mode selection.

Figure 3:
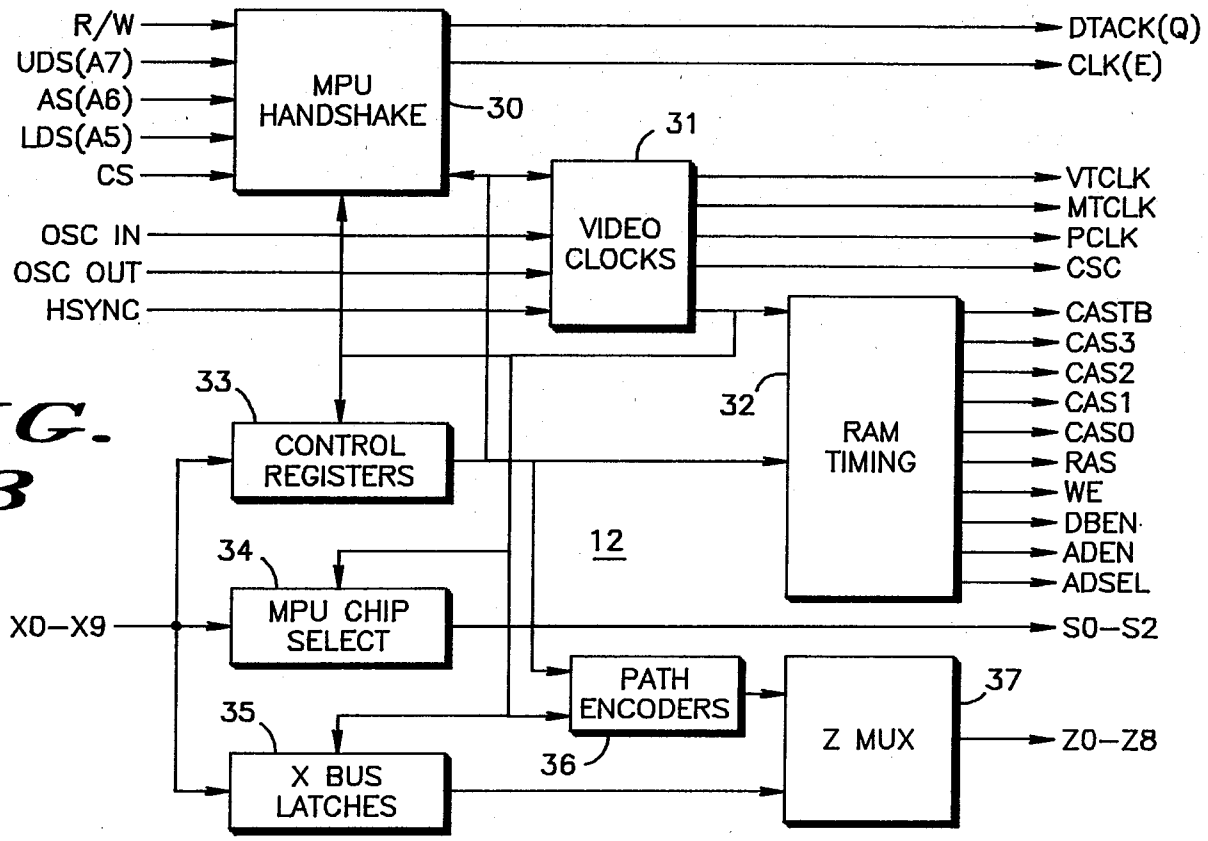
FIG. 3 is a block diagram of the interface section of the present invention.

FIG. 3 illustrates RMI 12 in greater detail. RMI 12 is the interface unit for the video display system and serves as the interface between the dynamic RAM and the microprocessor's address and control lines. RMI 12 translates the microprocessor's address bus into the information needed on the RAM address bus. It also provides all of the timing signals required by the RAM, and its outputs are capable of driving up to 32 dynamic RAMs directly without additional buffering. RMI 12 has to determine how the RAMs will be accessed so that both the microprocessor and RMC 11 can access the RAM at high speed without interfering with each other. RMI 12 makes extensive use of page mode accesses to utilize the RAM as efficiently as possible.

MPU handshake circuit 30 receives several inputs and determines at power up which MPU is being used so it then knows which handshaking lines to use. MPU handshake 30 receives R/W signal from the MPU and uses this signal to control the direction of data flow for MPU accesses to either the RAM or control registers 33. Address strobe signal (AS) is an input from the MPU and is used in conjunction with the M68000 family MPUs. When the M6809E is used this signal is an extra performance option which uses bit 6 of the address when the user plans to make use of the 3-bit device select bus SO–S2. The reason for connecting address bit 6 to RMI 12 is to provide early knowledge of the state of address bit 6. Address bit 6 is normally multiplexed into the system at the second X bus cycle which is too late to provide an external device select in time for the current memory cycle. Upper data strobe (UDS) is similar to the AS line in that it is optional with the M6809E MPU. Address bit 7 of the MPU is used as this input. If an M68000 MPU is used, then the UDS input is provided by this MPU. Lower data strobe (LDS) is provided when an M68000 MPU is used and is optional with the M6809E MPU. The option is used to acquire address bit 5 of the MPU. Chip select (CS) must be a logic level low in order to enable the video display system. Systems that take advantage of the address range available and the device select bus SO–S2 to perform all addressing may ground this pin (CS) to permanently enable the system. This is especially helpful for 8-bit MPU systems whose address range is less than or equal to that of the system. Systems not using the full one megabyte addressing range must decode the most significant address lines to provide CS. A simple case is decoding the most significant 4-bits to select a single 1 megabyte block from the M68000 16 Mbyte address base. CS signal is only used to control the MPU access to the video display system. The video display will be maintained no manner what level is applied to the CS line. MPU handshake 30 provides a data acknowledge (DTACK) output signal which is used as a clock output in M6809E systems and as a handshaking line in M68000 family systems. DTACK is used to inform the microprocessor that the external device that it was accessing has completed the requested task. RMI 12 also provides a CLK (E) signal which serves as the MPU basic clock. For the M68000 family MPUs CLK (E) is the master oscillator frequency divided by 4.5, which is 7.95 MHz for 525 line timing and 7.88 MHz for 625 line timing. MPU handshake 30 also sends and receives data to video clocks 31, RAM timing 32, and control registers 33.

Video clocks 31 has an oscillator input and an oscillator output which are connected to a crystal oscillator. Horizontal sync (HSYNC) is also received by video clocks 31. Video clocks 31 is use to generate all of the internal clocks required by the video display system. It is also the base for deriving the color subcarrier (CSC) and the MPU clocks. Video clocks 31 provides outputs to RAM timing 32, control registers 33 and MPU handshake 30. In addition, video timing clock (VTCLK) is provided to RMC 11 which uses this signal to generate horizontal and vertical sync pulses and blanking, as well as, for internal timing. Two other signals provided to RMC 11 are memory timing clock (MTCLK), which is used to keep track of memory cycles and picture element clock (PCLK) which is used to clock each picture element video data out of RMC 11. The horizontal sync (HSYNC) input to video clocks 31 is used between RMI 12 and RMC 11 to maintain synchronization between the various clocks in the system. One of the unique and advantageous features of the present invention is the method of using the horizontal sync to start the beginning of each horizontal scan line. This feature avoids requiring the PCLK to have an integer number of clock cycles in a horizontal scan line. In the present system the PEL clock, PCLK, and memory timing clock, MTCLK, are shut off briefly at the end of the line and restarted at the beginning of the line in a consistent phase relationship with respect to the HSYNC. This means that every line will have the same phase relationship.

RAM timing 32 receives inputs from video clocks 31 and from control registers 33 and provides the RAM control signals such as CASTB, CAS 0–3 signals, RAS, and write enable (WE) signal. In addition, RAM timing provides the data bus enable (DBEN) signal, the address enable (ADEN) signal, and the address select (ADSEL) signal. Data bus enable signal is used in conjunction with R/W signal by RMC 11 to determine when, and in which direction, RMC 11 should enable the data bus to the MPU. Address enable signal is an active low signal generated by RMI 12. It is active for the first two words on X bus 18 (see FIGS. 1 and 2) for each memory cycle that allows an MPU access and enables the outputs of the multiplexers that place the MPU address information onto bus 18. Address select (ADSEL) signal is used in conjunction with the address enable (ADEN) signal to determine which data will be placed on bus 18. When ADEN is a logic level high and address enable is a logic level low, the most significant MPU address bits will be placed on bus 18. When address select is a logic low and address enable is a logic low the MPU least significant address bits will be placed on bus 18. The address select is active only during the first two words on bus 18.

Control registers 33 receive inputs from X bus 18 on X0–X9 inputs and provides outputs to RAM timing 32. Control registers 33 also receive inputs from MPU handshake 30 and video clocks 31. X bus inputs X0–X9 are used as a major means of passing information from RMC 11 to RMI 12, and is also used to bring MPU addresses into the video display generator of RMC 11. Eight different words are passed on the X bus during each memory cycle. The time division multiplexing is controlled by MTCLK with some help from ADEN and ADSEL.

MPU select 34 also receives inputs on X0–X9 and inputs from video clocks 31 and provides output S0–S2. MPU chip select 34 has address decoding logic which provides outputs S0–S2 to indicate which device the MPU is trying to communicate with.

X bus latches 35 receive inputs X0–X9 and also an input from video clocks 31. X bus latches 35 temporarily store MPU addresses and provide these as outputs to Z MUX 37. Z MUX 37 is a multiplexer receiving inputs from X bus latches 35 and from path encoders 36 to provide row and column addresses on output Z0–Z8. Z MUX 37 provides an output on a 9-bit bus which can be directly connected to the address lines of the RAMs. If the RAM device types do not require a 9-bit address some of the most significant Z outputs (Z0–Z8) will not be used. Path encoders 36 receive inputs from video clocks 31 and control registers 33. The data received from control registers 33 tells the path encoders 36 which type of RAM is being used so the Z MUX 37 outputs will be compatible with the RAM.

Figure 4:
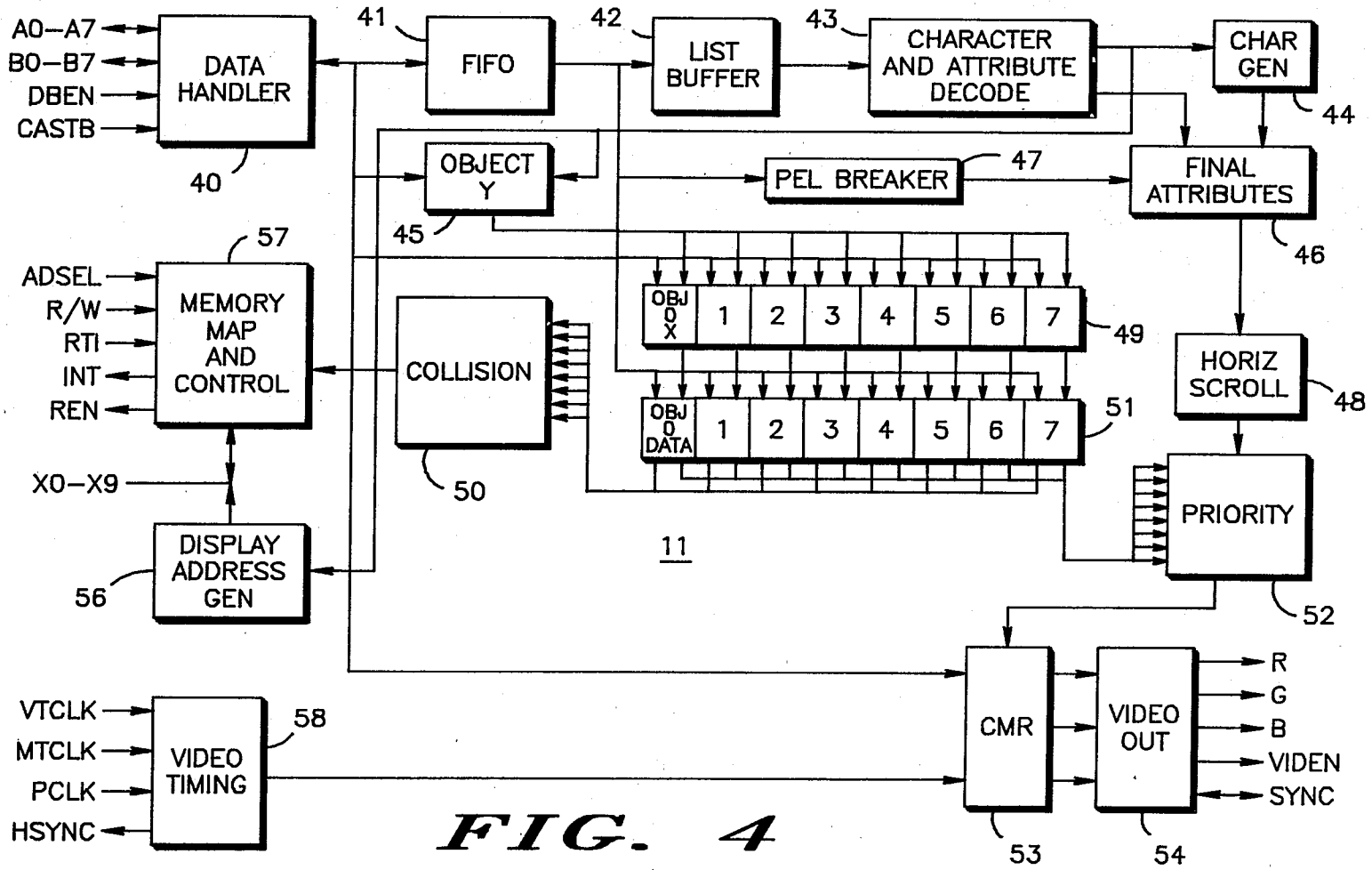
FIG. 4 is a block diagram of the control section of the present invention.

FIG. 4 illustrates RMC 11 in greater detail. RMC 11 is responsible for generating the actual video output. It also determines the addresses of the locations in RAM that must be accessed to create the video and processes the raw data received from RAM to create the video. Data handler 40 receives A port data on inputs A0–A7 and B port data on inputs B0–B7. These two ports also serve as outputs. Data handler 40 receives data bus enable (DBEN) signal and CASTB signal. Data handler 40 is connected by an 8-bit bus to FIFO 41, object Y address and compare 45, object X 49, and color mapping RAM (CMR) 53. Data handler 40 includes registers and multiplexers to latch and route data to its proper destination. In a preferred embodiment, FIFO 41 includes 8 eight-bit registers having separate inputs and outputs. All video proceeds from data handler 40 to FIFO 41. FIFO 41 is used to smooth out the flow of data. The data will be received during a burst that lasts a few hundred nanoseconds and will then have to be used relatively slowly throughout the next microsecond. The data from FIFO 41 is passed onto list buffer 42 for more permanent storage. This buffer 42 has two memories. Each memory is large enough to hold all of the list data that the system will require for one character row. A character row consists of at least eight and not more than sixteen video scan lines. All of the data in the list buffer will be used during each scan line. Therefore the data is reused several times during a single video field. Since there are two complete memories in list buffer 42, while one of the memories is being used the other can be refilled a few bytes at a time during the course of several horizontal lines. Display address generator 56 is capable of remembering where it left off filling the list buffer on one line and picking up at that point during the next horizontal blanking period. The data is passed from this list buffer 42 to character and attribute decode 43 at a character rate. The amount of data that defines a single character may be from one to three bytes depending on list mode. This variable width data is received by decoder 43 so that logic therein can interpret the data based on the list mode in use. The output of decoder 43 consists of a character code word and attribute data. The system is capable of generating a large number of attributes such as double high, flash, priority, and many others. Some of these attributes will be implemented at this time while others will have to wait until after the pixel pattern data has been fetched. The character code word out of decoder 43 has a choice of three paths. Two paths lead to the internal character generators which contain predetermined pixel patterns for 96 ASCII characters and mosaic graphics. The third path is used if the list data contains an attribute for a redefineable character. If the character is redefineable, then the character code will be routed to display address generator 56 where it will be used along with other data to calculate an address in RAM where the pixel pattern for this character can be found. This data will be fetched from RAM in the normal fashion and routed through FIFO 41 and into PEL breaker 47 where it will be broken into pixels by the same method used for bit plane data. These characters are referred to as redefineable because their pixel patterns are stored in RAM. The MPU stores these patterns in RAM and they may be changed as needed.

Character generator 44 receives inputs from decoder 43. Character generator 44 is actually two character generators wherein one stores pixel pattern for alphanumeric characters and the other stores mosaic graphics data. In a preferred embodiment, the pixel pattern storage is nine words of seven bits for each character. The paths of redefineable and predefined character data comes back together at final attribute 46. Final attribute 46 contains logic to implement the attributes and any attributes that are dependent on the pixel pattern such as invert are implemented at this time. By applying the attributes at this point the image table contents do not have to be altered. Some of the attributes are defined for videotext and word processing while others are intended for games. The display list that contains the identifiers for the characters to be put on the screen also contains flags that allow each of these characters to be individually modified. These individual features are called attributes and every list mode allows some. Foreground color and background color can be selected as can flash, inverting, underlining, double high, double wide, color/resolution, separation, priority, collision enable, color collision, and shading.

When flash is used with one bit per pixel characters it causes the foreground color to become the same as the background color momentarily at a regular rate. Invert causes the video pattern to be inverted which results in reversing the foreground and background colors. Underlining applies to alphanumeric and some redefineable characters. Double high characters are stretched to twice their normal height while the width remains the same. Care must be taken when using double high characters and vertical scroll. The double wide attribute causes a character to be displayed with twice its normal width but with normal height. Care must be used when using double wide characters and horizontal scroll since there can be a problem when the screen has been scrolled so that only the right half of the double wide character is displayed. The color/resolution attribute allows some redefineable characters to trade resolution for an increased color range. The separation attribute is only used on mosaic characters and changes the format of the block so that some background color will show through even if all of the blocks are on. The priority attribute is used to simulate a third dimension in the display. The priority attribute is used to determine which item is in front (visible) when two objects occupy the same place on the screen. The higher the value of the priority attribute the closer the character is considered to be to the front of the screen. None of the ROM based or redefineable characters can share space with any others, therefore, priority becomes useful only with true objects, which are objects that can be displayed anywhere on the screen. Collision enable is another attribute of fixed objects to make them easier to use in game applications. A true object with collision enable can collide with fixed objects that also have a collision enable bit set. That is, when a true object and a fixed object try to occupy the same X-Y location on the screen a collision will be reported only if they both have their collision enable set. Color collision is used with fixed objects to determine which part of the fixed object is allowed to cause a collision. The shading attribute is a fixed object attribute that affects true objects with higher priority when they move in front of the fixed object.

The pixel data out of final attributes 46 goes to horizontal scroll 48. Horizontal scroll 48 is a shift register wherein any bit of the shift register can be selected to be sent first to priority circuit 52 thereby providing horizontal scrolling. A more detailed description of the horizontal scrolling feature can be found in co-pending patent application Ser. No. 551,809. Final attribute 46 also receives inputs from PEL breaker 47. PEL breaker 47 has a one byte latch and a multiplexer. The one byte latch receives input data and then provides the data to the multiplexer. The byte is reduced to pixel size data and then transferred to final attributes 46. Object X 49 will hold eight objects and each object box therein contains a register and comparator. The output of the comparator serves as a start control for the associated object data block 51. Object data 51 receives data from FIFO 41. Each box of object data 51 is basically a shift register and the speed at which data can be clocked out of object data 51 can be controlled to achieve a zoom effect. Each block within object data 51 has a programmable divider for dividing down the clock signal. Each comparator in the boxes of object X 49 compares the data against a counter in video timing 58. The data from object data 51 can go to priority circuit 52 and to collision circuit 50. A more detailed description of object generation can be found in co-pending patent application Ser. No. 551,814. The output of priority circuit 52 goes to CMR 53. CMR 53 also receives inputs from data handler 40 and from video timing 58. CMR 53 is a small RAM which in a preferred embodiment has 32 registers. Each register can be set to any one of 4096 colors. A pixel has no absolute color associated with it. One pixel may have a different data value than another but there is no information about what any pixel will actually look like on the screen. The 5-bit pixel received from priority circuit 52 serves as the address to thirty-two word CMR 53. Each CMR location contains a 12-bit data word that was directly programmed by the MPU. This 12-bit word defines the color that a particular pixel would generate. The 12-bit word consists of a 4-bit nibble each for the R, G, and B outputs. These outputs are sent to video out circuit 54 which has three separate 4-bit D-to-A converters, one each for R, G, and B. Video out 54 provides the R, G, B and video enable output signals. Video out 54 also has a Sync line which serves as a dual purpose; it can be used either as an output for a sync signal or as a frame sync input. As an output, Sync provides composite sync, block vertical sync, or horizontal sync. Composite sync will include equalizing pulses if the video display system is being operated in interlace mode. There will not be equalizing pulses if the system is being operated in non-interlaced mode.

Collision circuit 50 provides an output to memory map and control 57. Memory map 57 is interconnected with X0–X9 and to display address generator 56. Memory map and control circuit 57 is mostly an address decoder and receives inputs such as address select, R/W, and RTI. RTI is a real time input and may be used as an input for a light pen. A falling edge on the RTI input causes the current value of X and Y counters, used to position true objects, to be loaded into registers that can be read by the MPU and memory map and control 57. Memory map and control 57 provides an interrupt output and a reset enable (REN) signal. Resets are accomplished by means of the reset enable signal REN. Collision 50 contains eight bytes of registers for collision reporting. There is one register for each true object. The bits within a true object collision register indicate which of the other true objects it has collided with since the last time the register was read. Before an object can have a reportable collision its collision enable bit and the collision enable bit of the true object or fixed object it collides with must both be set otherwise the collision will not be recorded.

Display address generator 56 receives inputs from controller 57, decoder 43, and the MPU. It generates addresses which are put on outputs X0–X9 which is the same bus, 18, on which it receives inputs from the MPU. Display address generator 56 contains an arithmetic and logic unit having two busses. Each of the busses has a plurality of registers which are controllably coupled thereto. The registers contain the necessary information to generate addresses and by connecting them in the proper order under microcode control addresses are generated. Display address generator 56 is described in greater detail in co-pending patent application Ser. No. 551,813.

Video timing 58 receives clocking inputs VTCLK, MTCLK, and PCLK, from video clocks 31 (FIG. 3). Video timing 58 provides HSYNC signal among other signals required for the video display system. Object Y 45 contains object Y addresses and also a comparator. Object Y 45 receives inputs from data handler 40 and decoder 43. It provides outputs to object X 49. Since the object Y address and compare function does not require dedicated logic for each true object it is practical to incorporate this function into display address generator 56.

During the power up phase the MPU must program certain control registers within the interface and control units in order to define the environment that the system will be operating in. Examples include the types of RAMs being used and the number of banks of RAMs. The control registers should appear in the memory map. If an 8-bit MPU is in use the user must decide how memory paging will be used. After the system has been configured, the MPU will go on to configure the video generator itself. Items that would be included in this catagory include the resolution of the displayed and virtual screens, choice of non-interlace or interlaced sync signals, self sync or sync to external video, where in memory the main screen and pattern tables will be stored, what colors will be in use, which true objects will be in use, and which display mode will be used (list or bit plane mode).

The use of the RAM is time division multiplexed between the MPU and the display process. While the MPU receives one piece of data during its 300 nanoseconds share of each memory cycle the display process can receive up to four times as much data during its 700 nanoseconds.

There are several types of display operations but the address generation always occurs in the same manner. Bit plane mode is a simple mode in which data is fetched from memory and used with very little processing to form video. Each pixel on the screen is formed from a unique set of bits from RAM and has no interaction with other pixels or other bits of memory. The data required to generate the display is fetched at the same time it will be used. Data is generally in sequential addresses in memory. There may be some exceptions to this rule on a screen. If there are, the display address generator is equipped to handle the exceptions as well as a normal case. List modes differ from bit plane mode in that the first piece of data fetched from memory does not completely define a pixel or pixels. It provides some information about a relatively large number of pixels. However, memory will have to be accessed again before a pixel is completely defined. This second access may either be made to RAM or to a ROM internal to the control unit that is not visible to the user.

The most common application for list modes is to generate alphanumeric characters. Other applications are also possible. The first access made to determine a pixel value fetches the list data. The second access fetches the pixel pattern data. Since the second fetch could be made to RAM the list data fetch can not be made in real time. There is not enough time to perform both accesses. The fetch of list data is performed during horizontal blanking. The results go to FIFO 41 and are then passed onto list buffer 42 for more permanent storage.

True objects are different from other video data in that their positions on the screen are defined by the user and their positions are independent of all other display data including other true objects. The user programs the location where true objects will be displayed by using control registers in RMC 12. These registers amount to a set of X and Y coordinates for positioning the object. No immediate activity takes place after the user programs the position registers. A comparison is made and if the comparison is true then object data will be needed during this line. A true Y coordinate comparison starts the display address generator. Some of the control registers are used to hold character codes (character names) for the true objects. These codes are used by display address generator 56 in exactly the same fashion as the character codes of redefineable characters. An address is generated and used to fetch four bytes of data from RAM. These four bytes are used to define the pixel pattern of a true object during one video line. This data is stored in object X storage 49. There is a separate register for each of the eight true objects. The data is held in its register until the X coordinate programmed by the user compares with outputs of a counter that is running at pixel rate. When the comparison becomes valid, the data begins coming out of the object X registers 49. Each object has its own simplified version of the PEL breaker to break the data from bytes down to pixels. The data travels down to priority logic 52 for comparison against data from other objects and the background information coming from horizontal scroll 48.

The basic shape of the object is a rectangle. Rectangles do not fit most applications, so a particular pixel data code is reserved to represent transparent data. Transparent data from an object is ignored by priority logic 52. True objects also have the ability to collide with other objects or with elements of the background. The ability of true objects and of the background to collide is selected by the user. Collisions are tested for at the same time as priority but by collision logic 50. Note that priority and collision will commonly be used together by the programmer to make it appear that two true objects are on the same priority level and could not pass through each other. The present video system actually acts in a more general fashion where priority and collision are independent of each other and leaves the special case for implementation by software. Collisions are reported to the MPU via a matrix of registers in controller 57. There is one register for each true object. That register reports where the object collided with the background or another true object or objects. The user receives complete information about multiple collision.

True objects are very hardware intensive. A video display generator with a large number of true objects would be too expensive for the general marketplace. Therefore the present system provides only eight true objects, but it also provides the means for reusing them during a single video field. If an object was used near the top of the video screen, it can be set to generate an interrupt after all its video data has been output. The MPU can then reprogram the object logic to display another character later during the video field. In some applications it would be possible to reuse the same set of hardware several times during a single video field.

By now it should be appreciated that there has been provided a programmable video display generator useable for personal and home computers as well as videotext systems. The system is capable of supporting up to one megabyte of RAM including refresh. The system is highly versatile while using a minimum amount of circuitry.

I claim:

1. A video control section and interface section for use in various video display systems having differing microprocessors and memories wherein the interface section comprises: clock circuitry for providing clocking signals for the video display system; memory timing circuitry receiving an input from the clock circuitry and providing memory control signals; control registers for receiving inputs from the microprocessor and the memory for providing a control input to the memory timing circuitry and to the clock circuitry; a microprocessor select circuitry, for providing an output indicating to which circuitry the microprocessor is sending commands, receiving inputs from the microprocessor and the clock circuitry; and a multiplexer for receiving addresses from the microprocessor and converting the addresses into row and column addresses; and wherein the control section comprises a data handler coupled to the microprocessor and the memory for latching and routing data within the video display system; a plurality of registers coupled to the data handler for temporarily storing data from the data handler; a decoder coupled to the plurality of registers for decoding character and attribute data; a character generator coupled to the decoder for storing character pattern information; a byte reducer coupled to the plurality of registers and receiving bytes of data and reducing the bytes to picture element size; logic circuitry, for implementing attributes to video to be displayed, coupled to receive inputs from the byte reducer, the decoder, and the character generator; a first shift register coupled to receive data from the logic circuitry for controllably shifting out data from any location within the first shift register to achieve scrolling of the video in one direction; object circuitry coupled to the data handler for receiving object data from said data handler to generate a display for the object; a second shift register coupled to the object circuitry and to the plurality of registers for shifting data out; a priority circuit coupled for receiving data from the second shift register and the first shift register to determine priority of the data from said first shift register and said second shift register on a picture element by picture element basis; a color mapping RAM coupled for receiving data from the priority circuit and the data handler and providing color data; a video out circuit for receiving said color data and for providing video color signals to a display unit; a display address generator receiving inputs from the decoder and the microprocessor and providing memory addresses; and a memory map and controller, for decoding addresses, coupled for receiving inputs from the microprocessor and the display address generator.

2. The video display system of claim 1 wherein the interface section further includes a path encoder coupled between the control registers and the multiplexer to provide information on the type of memory being used; and circuitry for providing information on the type of microprocessor being used.

3. The video display system of claim 1 wherein the control section further comprises temporary storage coupled between the plurality of registers and the decoder; and circuitry for reporting collisions between true objects, coupled between the second shift register and the memory map and controller.

4. The video display system of claim 1 wherein the decoder is a programmable logic array, and the byte reducer includes a latch and multiplexer.

5. A programmable video display generator for use in various video display systems having differing microprocessors and memories, and a display unit, the programmable video display generator including an interface unit and a control unit wherein the interface unit comprises: first means for identifying the type of microprocessor being used; second means for providing clocking signals for the video display unit; third means receiving an input from the second means and providing memory control signals; fourth means coupled to the microprocessor for temporarily storing control signals and providing an output to the third means; fifth means receiving inputs from the microprocessor and providing addressing signals which indicate to which circuit the microprocessor is communicating; sixth means receiving addresses from the microprocessor and temporarily storing the addresses; seventh means receiving inputs from the second and fourth means to provide an output indicative of the type of random access memory being used; and eighth means receiving inputs from the sixth and seventh means and providing row and column addresses for the random access memory; and the control unit comprises: ninth means for receiving data from the memory and routing the data to its proper destination; tenth means for receiving data from the ninth means and temporarily storing the data; eleventh means receiving data from the tenth means and arranging the data to represent a character; twelfth means receiving data from the eleventh means and decoding the data; thirteenth means receiving data from the twelfth means and providing output data in picture element pattern; fourteenth means receiving inputs from the twelfth and thirteenth means for implementing attributes for displayed information; fifteenth means receiving data from the tenth means and reducing the data to picture element size and providing an output to the fourteenth means; sixteenth means receiving inputs from the fourteenth means for allowing selectively accessing the data to provide scrolling of the displayed information; seventeenth means coupled for receiving data from the ninth means for handling data in object format; eighteenth means coupled for receiving data from the tenth and seventeenth means and shifting out data in object format; nineteenth means receiving data from the sixteenth and eighteenth means for determining priority of the data to be displayed; twentieth means receiving data from the twelfth means and from the microprocessor for generating display addresses; twenty-first means receiving data from the ninth and nineteenth means for providing color information; and twenty-second means receiving data from the twenty-first means and generating video color signals for transmission to said display unit.

6. The programmable video display generator of claim 5 wherein the control unit further comprises twenty-third means receiving data from the eighteenth means and determining whether a collision between true objects, has occurred among the object data.

* * * * *